US007997557B2

(12) United States Patent
Zui et al.

(10) Patent No.: US 7,997,557 B2
(45) Date of Patent: Aug. 16, 2011

(54) EXHAUST GAS RECIRCULATION VALVE AND METHOD OF PRODUCING EXHAUST GAS RECIRCULATION VALVE

(75) Inventors: Takuro Zui, Tokyo (JP); Haruo Watanuki, Tokyo (JP); Sotsuo Miyoshi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/919,158

(22) PCT Filed: Jan. 14, 2009

(86) PCT No.: PCT/JP2009/000107

§ 371 (c)(1), (2), (4) Date: Aug. 24, 2010

(87) PCT Pub. No.: WO2009/125526

PCT Pub. Date: Oct. 15, 2009

(65) Prior Publication Data

US 2011/0017934 A1 Jan. 27, 2011

(30) Foreign Application Priority Data

Apr. 8, 2008 (JP) ..... 2008-100514

(51) Int. Cl.
*F02M 25/07* (2006.01)

(52) U.S. Cl. .... 251/214; 251/337; 403/314; 123/568.11

(58) Field of Classification Search ..... 251/214, 251/337, 129.01; 123/568.11; 403/314
See application file for complete search history.

(56) References Cited

U.S. PATENT DOCUMENTS

| | | | | |
|---|---|---|---|---|
| 4,742,989 | A * | 5/1988 | Akagi | 251/129.05 |
| 5,184,593 | A * | 2/1993 | Kobayashi | 123/568.24 |
| 5,713,315 | A * | 2/1998 | Jyoutaki et al. | 123/90.12 |
| 5,937,835 | A | 8/1999 | Turner et al. | |
| 6,193,211 | B1 * | 2/2001 | Watanabe et al. | 251/129.11 |
| 2003/0116743 | A1 * | 6/2003 | Kawasaki | 251/337 |

FOREIGN PATENT DOCUMENTS

| | | | |
|---|---|---|---|
| JP | 8-49785 | A | 2/1996 |
| JP | 8-151963 | A | 6/1996 |
| JP | 9-32654 | A | 2/1997 |
| JP | 11-62724 | A | 3/1999 |
| JP | 2004-52648 | A | 2/2004 |

* cited by examiner

*Primary Examiner* — John Bastianelli
(74) *Attorney, Agent, or Firm* — Birch, Stewart, Kolasch & Birch, LLP

(57) ABSTRACT

A valve shaft 8 and a drive shaft 11 of an EGR valve 1 are butted to each other; protrusions 26*a*, 26*b*, 27*a*, and 27*b* formed on the inner sides of cotter members 24, 25 of a cotter 23 are engaged with grooves 21, 22 respectively formed on the outer peripheral surfaces of the ends of the shafts 8, 11; the urging force of a spring 28 for exerting an urging force in the closing direction of valve disks 6, 7 on the cotter 23 is applied to the cotter 23 through a spring holder 30 to press the protrusions 26*a*, 26*b*, 27*a*, and 27*b* to the grooves 21, 22.

8 Claims, 7 Drawing Sheets

(C)

(D)

(E)

(F)

EXHAUST GAS RECIRCULATION VALVE AND METHOD OF PRODUCING EXHAUST GAS RECIRCULATION VALVE

TECHNICAL FIELD

The present invention relates to an exhaust gas recirculation valve provided in a recirculation passage of the exhaust gas of an engine and a method of producing the exhaust gas recirculation valve.

BACKGROUND ART

In the engine of an automobile, an exhaust gas recirculation passage for recirculating the exhaust gas thereof to the intake side is provided with the objective of reducing $NO_x$ in the exhaust gas or other objectives. An exhaust gas recirculation valve (EGR valve) for opening and closing the passage is provided in the exhaust gas recirculation passage. The EGR valve consists of a valve section and a drive section (actuator section) for the valve section, and a valve shaft in the valve section and a drive shaft in the drive section for driving the valve shaft are formed not integral with each other but separately therefrom for reasons of structure, design, or the like. The opening operation of the valve in the valve section is performed by the abutment and push of the drive shaft in the drive section against and to the valve shaft. The closing operation of the valve is carried out by the urging force of a spring applied to the valve.

In such an EGR valve, when soot (deposit) or the like contained in the engine exhaust gas enters a space between the valve shaft and a bearing thereof and adheres thereto, the valve shaft cannot return to a closed position only by the urging force of the spring and can be fixed in an opened position. Forming the valve shaft integrally with the drive shaft makes it possible to cause the valve shaft to perform opening and closing operations by output of the drive section. Such a technology is disclosed, e.g., in Patent Documents 1, 2, and 3.

Patent Document 1: JP-A-08-151963 (JP-A-1996-151963)

Patent Document 2: JP-A-09-032654 (JP-A-1997-032654)

Patent Document 3: JP-A-08-049785 (JP-A-1996-049785)

However, in the exhaust gas recirculation valve disclosed in Patent Document 1, a valve shaft and a motor shaft is not completely unitized, and further, in the ones disclosed in Patent Documents 2 and 3, the structure for unitizing a valve shaft and a motor shaft is extremely complicated. Furthermore, there is a constraint that the outer diameter of at least one of the shafts cannot be made larger than the outer diameter of a portion sliding in a bearing of the valve shaft (the internal diameter of the bearing).

The present invention has been made to solve the above-described problems, and an object of the present invention is to simplify the structure of an exhaust gas recirculation valve, and further to enable a valve shaft and a drive shaft to be unitized even if a portion of which the outer diameter is larger than the inner diameter of a bearing for supporting the valve shaft is provided on both sides with the bearing as a boundary.

DISCLOSURE OF THE INVENTION

The present invention is an exhaust gas recirculation valve including a drive unit having a drive shaft that is translated; a valve shaft which has a valve disk that is closed and opened to and from a valve seat provided in a valve housing and which is axially translated by the translatory force of the drive shaft; a spring for urging the valve shaft and the drive shaft in a valve closing direction through a spring holder; and a bearing for journaling or supporting the valve shaft, wherein a fastening member for fastening the end of the drive shaft and that of the valve shaft to each other is provided when it is radially urged by the spring through the spring holder.

According to the exhaust gas recirculation valve according to the present invention, the valve shaft and the drive shaft are fastened to each other by applying radially inwardly the urging force of the spring to the fastening member through the spring holder, and thus the structure thereof is extremely simplified. Further, even if a member larger than the inner diameter of the bearing for supporting the translation of the valve shaft is provided on both sides of the bearing, the drive shaft and the valve shaft can be unitized. Furthermore, the valve shaft and the drive shaft are axially unitized, and thus, even if the valve disk and the valve shaft go to a sticking state, the valve shaft can be lifted by the drive force of the drive unit. Since the fastening member is not provided by press fitting or welding, assembly and quantity production of the valve can be improved, and disassembling and reassembling thereof can also be facilitated.

BRIEF DESCRIPTION OF THE DRAWINGS

FIGS. 6-1(A) and (B) each are an explanatory view of the assembly process of the valve shaft and the drive shaft by the cotter.

FIGS. 6-2(C) and (D) each are an explanatory view of the assembly process of the valve shaft and the drive shaft by the cotter.

FIGS. 6-3(E) and (F) each are an explanatory view of the assembly process of the valve shaft and the drive shaft by the cotter.

BEST MODE FOR CARRYING OUT THE INVENTION

Embodiments of the present invention will now be described with reference to the accompanying drawings in order to explain the present invention in more detail.

First Embodiment

Figure 1:
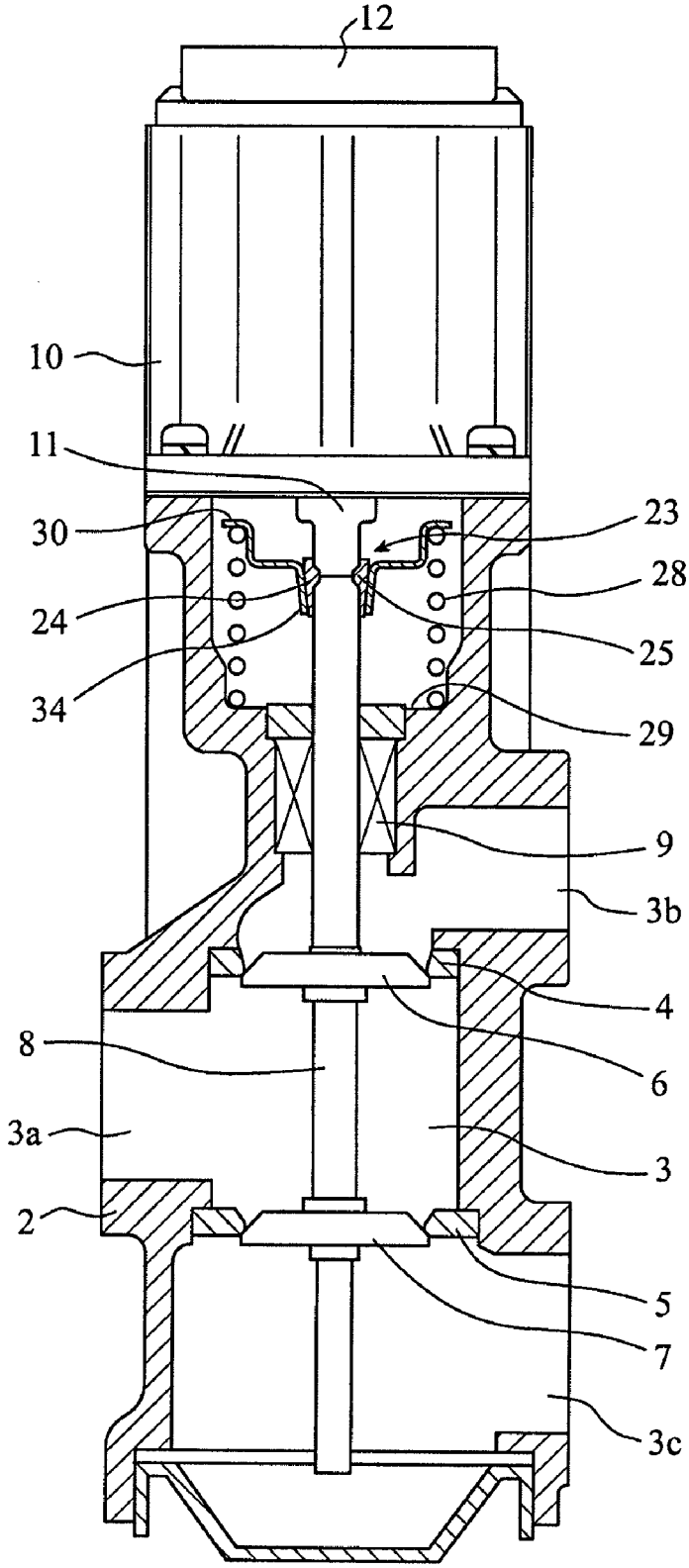
FIG. 1 is a sectional view of an EGR valve in accordance with a first embodiment of the present invention.
Figure 2:
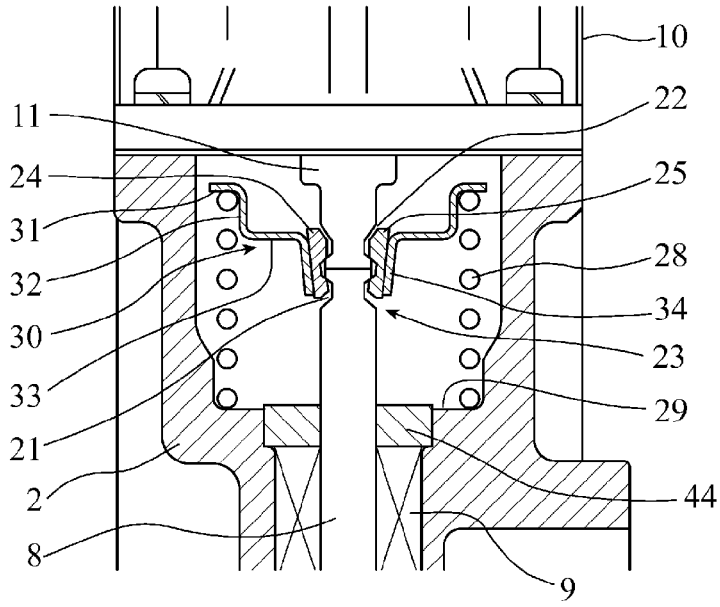
FIG. 2 is an enlarged sectional view of a portion where a valve shaft and a drive shaft are fastened to each other in the EGR valve in accordance with the first embodiment of the present invention.
Figure 3:
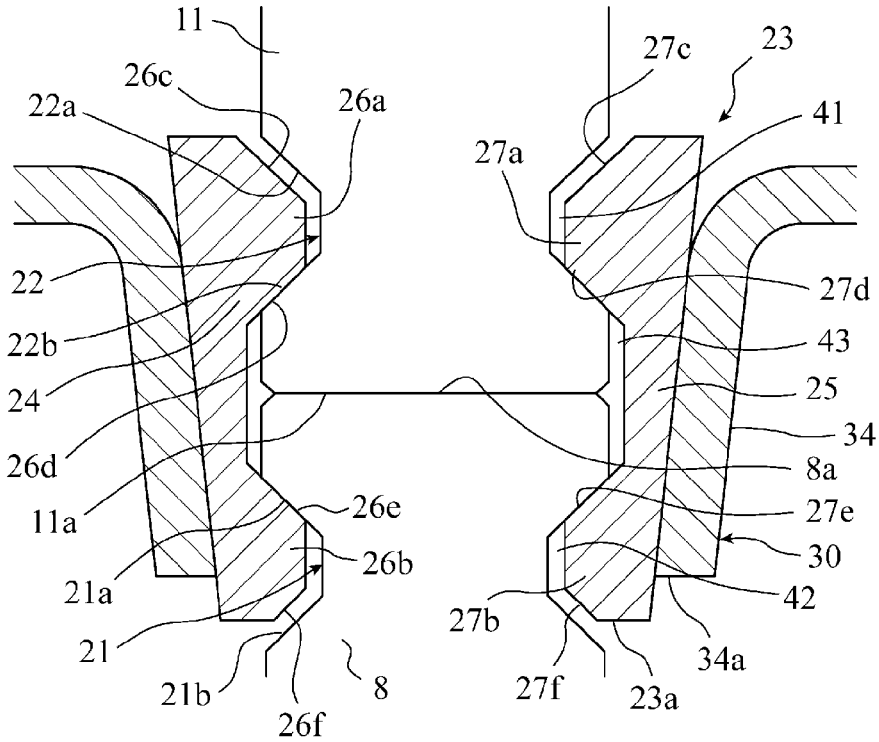
FIG. 3 is a further enlarged view of the portion where the valve shaft and the drive shaft are fastened to each other, shown in FIG. 2.

A first embodiment of the present invention will next be described by reference to the drawings in detail. In the first embodiment, the present invention is applied to an EGR valve of a double valve type having two pair of valve disks (valve bodies) and valve seats (valve seats). FIG. 1 is a sectional view of the EGR valve, FIG. 2 is an enlarged sectional view of a portion where a valve shaft and a drive shaft thereof are fastened to each other, and also FIG. 3 is an enlarged view thereof. Of course, the present invention can also be applied to a single type valve having a pair of a valve disk and a valve seat in a similar manner.

An exhaust gas passage 3 for passing an exhaust gas therethrough is formed in a valve housing 2 of an EGR valve 1; an inlet passage 3*a* is formed in communication with the exhaust gas passage 3; and outlet passages 3*b*, 3*c* are formed in communication with both the top and bottom sides of the exhaust gas passage 3 (in a vertical direction in the state shown in FIG. 1), respectively. Valve seats 4, 5 are formed in the valve housing 2 between the exhaust gas passage 3 and the outlet passages 3*b*, 3*c*, respectively. Valve disks 6, 7 are provided so as to be seat on or be moved off from the valve seats 4, 5. The valve disks 6, 7 are attached to a valve shaft 8 by press-fitting or the like. The valve shaft 8 is slidably supported or journaled in an axial direction by a bearing 9 assembled in the valve housing 2 on the upper side of the upper outlet passage 3*b*.

The upper end (rear end) of the valve shaft 8 is opposed to the front end of a drive shaft 11 of an actuator 10 that is a drive section provided on the valve housing 2. The actuator 10 is drive controlled by a command from an electronic controller (not shown). A valve position reading sensor 12 is provided on top of the actuator 10. The valve position reading sensor 12 detects opening and closing conditions of the valve disks 6, 7 from the position of the drive shaft 11.

A valve shaft side annular groove 21 is formed around the upper peripheral face of the valve shaft 8. Both walls of the valve shaft side groove 21 have tapered surfaces 21*a*, 21*b*, and the cross-section of the valve shaft side groove 21 is trapezoidal. A drive shaft side annular groove 22 is formed around the lower peripheral face of the drive shaft 11 as well. Both walls of the drive shaft side groove 22 also have tapered surfaces 22*a*, 22*b*, and the cross-section of the drive shaft side groove 22 is trapezoidal. The valve shaft 8 and the drive shaft 11 are integrally fastened to each other by engaging a cotter 23 as a fastening member with the valve shaft side groove 21 and drive shaft side groove 22.

Figure 4:
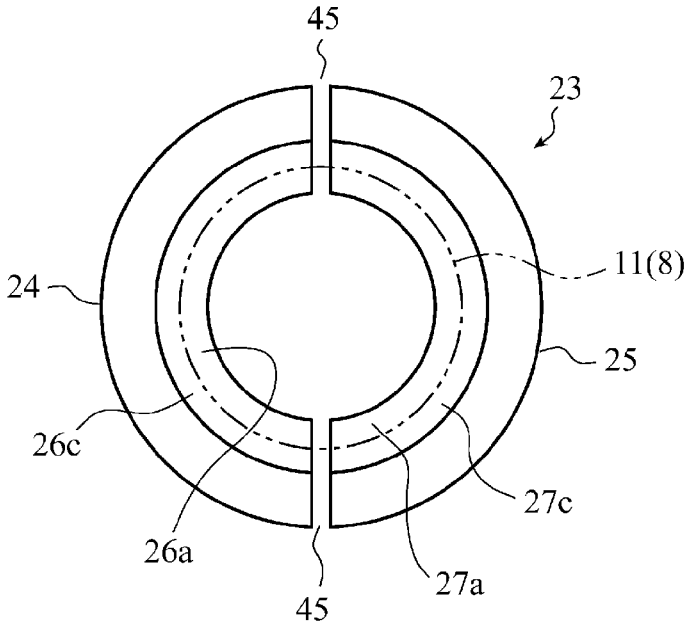
FIG. 4 is a plan view of a cotter.
Figure 5:
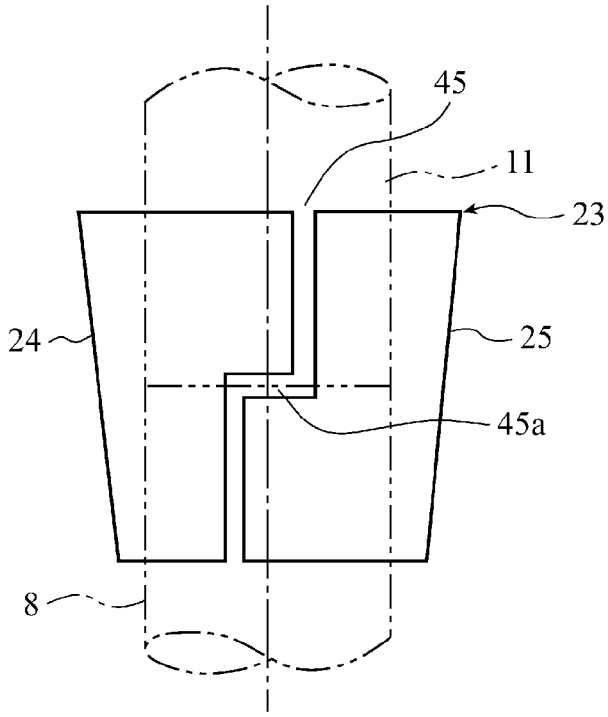
FIG. 5 is a side view of the cotter.

The cotter 23 consists of two cotter members 24, 25 as shown in FIG. 3 to FIG. 5. The cotter members 24, 25 each have a half tubular shape; protrusions 26*a*, 26*b*, and 27*a*, 27*b* projecting in a radially inward direction are formed on the upper and lower portions of the inner sides thereof, respectively. The walls on both the upper and lower sides of the protrusion 26*a* have tapered surfaces 26*c*, 26*d*, respectively, and the walls on both the upper and lower sides of the protrusion 26*b* have tapered surfaces 26*e*, 26*f*, respectively. Similarly, the walls on both the upper and lower sides of the protrusion 27*a* have tapered surfaces 27*c*, 27*d*, respectively, and the walls on both the upper and lower sides of the protrusion 27*b* have tapered surfaces 27*e*, 27*f*, respectively. The protrusions 26*b*, 27*b* on the lower sides of the cotter members 24, 25 are brought into engagement with the groove 21 of the valve shaft 8, and the protrusions 26*a*, 27*a* on the upper sides of the cotter members 24, 25 are brought into engagement with the groove 22 of the drive shaft 11. In a state that the upper and lower protrusions 26*a*, 26*b*, and 27*a*, 27*b* are engaged in the grooves 21, 22, respectively, the cotter 23 is formed such that the outer peripheral surface thereof provides a tapered surface reducing from the side of the drive shaft 11 toward the valve shaft 8 as shown in FIG. 3. The cotter 23 is formed, e.g., by sintering. Further, the cotter 23 are not limit to the two cotter members 24, 25, but may be composed of three or more cotter members.

A spring 28 is provided between the valve housing 2 and the valve shaft 8. The lower end of the spring 28 is supported by a spring receiver 29 in the valve housing 2. The upper end of the spring 28 abuts the spring holder 30.

The spring holder 30 is formed in a concave shape with an elastic material such as metal, and forms a collar 31 for receiving the upper end of the spring 28 at the upper part of the outermost portion thereof. There are provided a tubular guide 32 connected integrally to the inside of the collar 31, and an annular plate section 33 connected integrally to the tubular guide, and there is formed a tubular cotter thrust section 34 with a taper inside the annular plate section 33. The cotter thrust section 34 abuts against the tapered outer peripheral surface of the cotter 23 to push the cotter members 24, 25 inwardly in a radial direction so as to assemble or gather the cotter members. When the cotter members 24, 25 are resiliently pushed inwardly in a radial direction, the protrusions 26*a*, 26*b*, 27*a*, and 27*b* located inside the members are pressed against the groove 21 of the valve shaft 8 and the groove 22 of the drive shaft 11, and thereby the tapered surfaces 26*d*, 27*d* of the upper protrusions 26*a*, 27*a* of the cotter members 24, 25 abut against the tapered surface 22*b* of the groove 22, while the tapered surfaces 26*e*, 27*e* of the lower protrusions 26*b*, 27*b* thereof abut against the tapered surface 21*a* of the groove 21, and thereby the valve shaft 8 and the drive shaft 11 are axially integrally fastened to each other. At that time, the upper end face 8*a* of the valve shaft 8 abuts against the lower end face 11*a* of the drive shaft 11.

In a condition that the valve shaft 8 and the drive shaft 11 are fastened to each other as shown in FIG. 3, clearances 41, 42, and 43 are arranged to be formed: between the top faces of the protrusions 26*a*, 26*b*, 27*a*, and 27*b* (the top faces of the trapezoidal shapes shown in FIG. 3) of the cotter members 24, 25, and the bottom faces of the grooves 21, 22; and between the bottom face that is located between the protrusion 26*a* and the protrusion 26*b* and the bottom face that is located between the protrusion 27*a* and the protrusion 27*b* of the cotter members 24, 25, and the outer peripheral surfaces of the end portions of the valve shaft 8 and the drive shaft 11 located between the grooves 21, 22, respectively. Therefore, when the cotter members 24, 25 are pushed inwardly in a radial direction by the cotter thrust section 34 of the spring holder 30, the tapered surfaces 26*d*, 26*e*, 27*d*, and 27*e* of the cotter members 24, 25 can positively abut against the tapered surfaces 21*a*, 22*b* of the grooves 21, 22. Further, even if the abutment surfaces 8*a*, 11*a*, 26*d*, 26*e*, 27*d*, 27*e*, 21*a*, and 22*b* on which the valve shaft 8, the drive shaft 11, and the cotter members 24, 25 come in contact with each other are somewhat worn, the fastening state is maintained by a wedge effect.

A lower end face 23*a* of the cotter 23 projects downwardly further than a lower end face 34*a* of the cotter thrust section 34 of the spring holder 30. Meanwhile, a plug 44 against which the lower end face 23*a* of the cotter 23 can abut is provided on the upper side of the bearing 9.

The mating faces (opposing section) of the cotter members 24, 25 constituting the cotter 23 may be vertically straight; however, in order to prevent soot or the like in an exhaust gas from entering the portion, the opposing section may have a so-called labyrinth structure 45 in which the mating faces are bent as shown in FIG. 5. In the labyrinth structure shown in FIG. 5, bent faces 45*a* are arranged to trap the soot or the like. The labyrinth structure can have a plurality of bent portions.

Figures 1, 6:
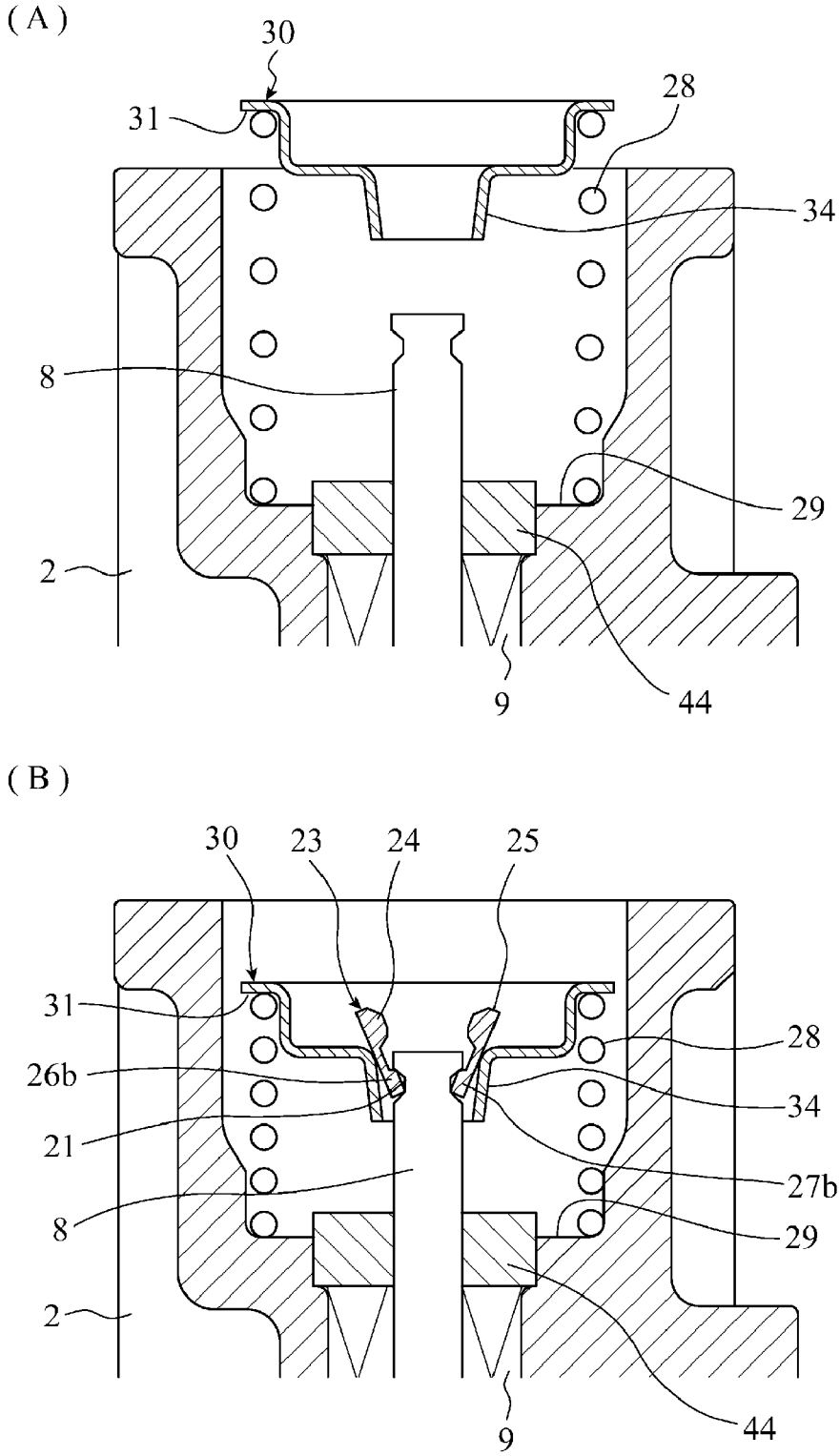
Figure 6:
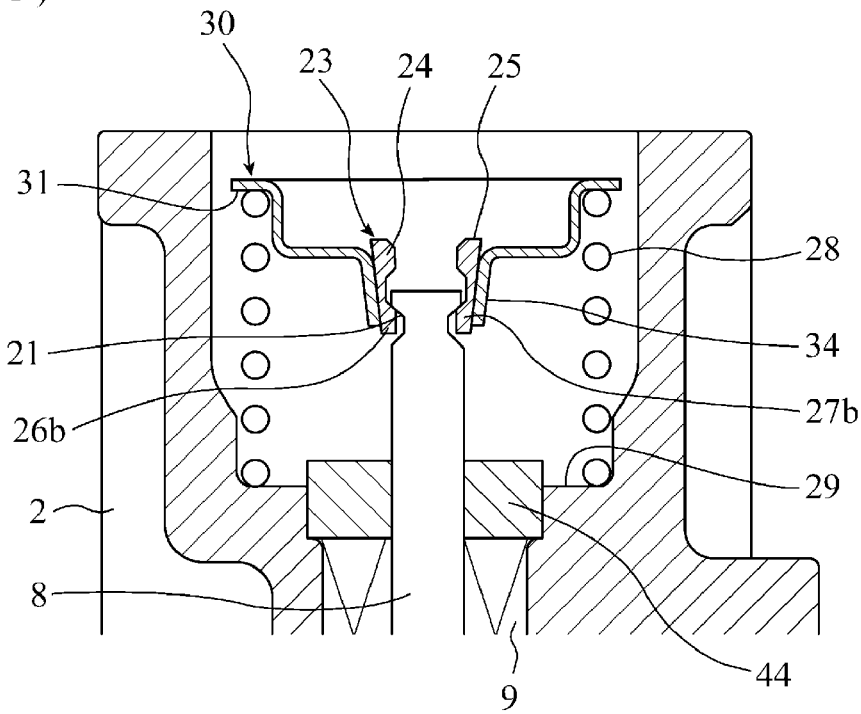
Figure 2:
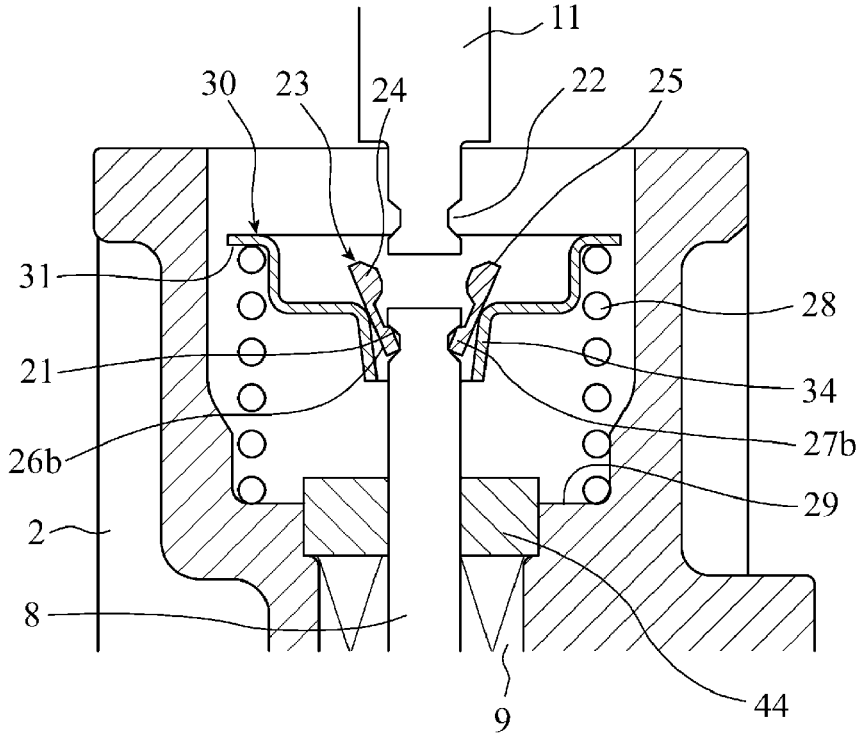
Figure 6:
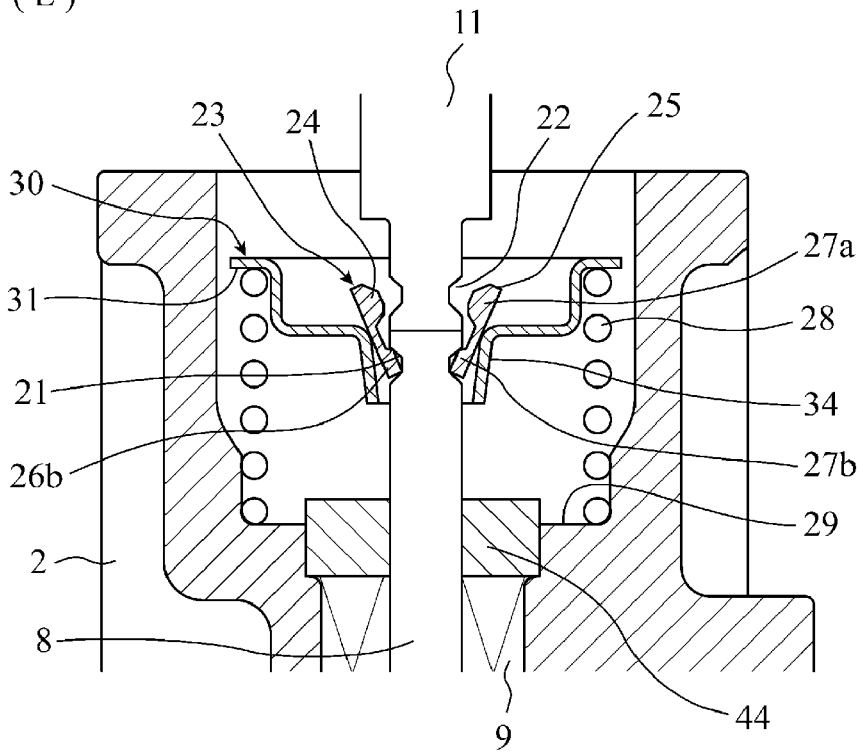
Figure 3:
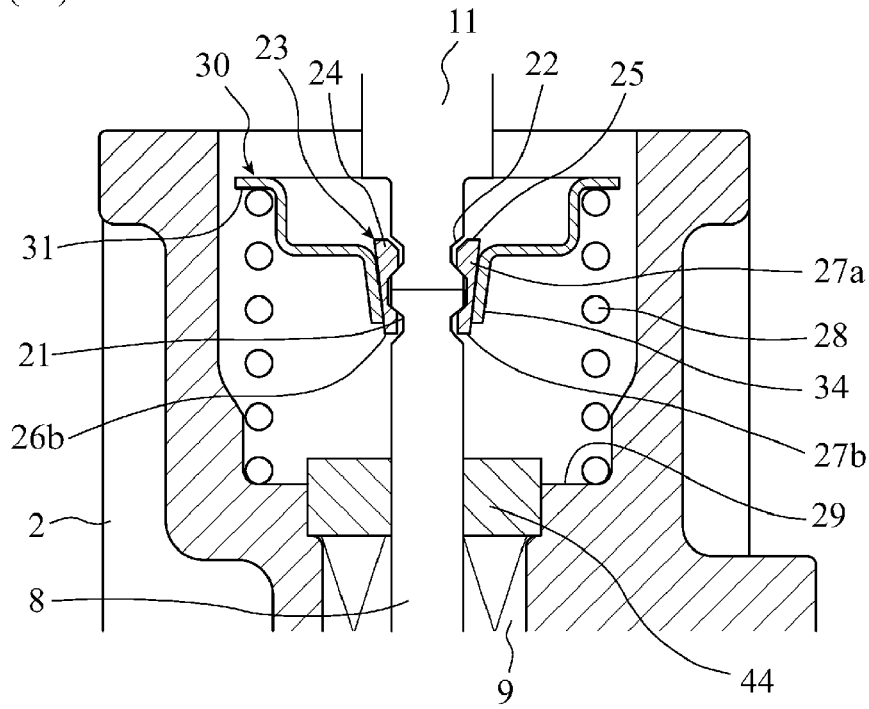

FIG. 6 illustrates a procedure of fastening the valve shaft 8 and the drive shaft 11 in the EGR valve to each other.

The valve shaft 8 having the valve disks 6, 7 attached thereto is assembled to the valve housing 2 to which the bearing 9 and the plug 44 are assembled. In the valve shaft 8, the top end portion thereof is passed through the bearing 9 and the plug 44 to project upwards from the plug 44. Thereafter, as shown in FIG. 6-1(A), the spring 28 is set, and then the spring holder 30 is set. In other words, the lower end of the spring 28 is placed on the spring receiving section 29 of the valve housing 2, and the collar 31 of the spring holder 30 is placed on the top end of the spring 28. Under such a condition, as shown in FIG. 6-1(A), since the spring 28 is put in a state where the spring 28 is extended, the spring holder 30 is located above the valve shaft 8.

Then, as shown in FIG. 6-1(B), the spring holder 30 is depressed until the cotter thrust section 34 thereof has the upper portion of the valve shaft 8 inserted thereinto, and the two cotter members 24, 25 constituting the cotter 23 are set inside the cotter thrust section 34. In other words, the lower protrusions 26*b*, 27*b* of the cotter members 24, 25 are fitted into the groove 21 located at the upper portion of the valve shaft 8.

Subsequently, as shown in FIG. 6-2(C), the force having depressed the spring holder 30 is released. The spring holder 30 is thrust back by the urging force of the spring 28. When the spring holder 30 is thrust back, the cotter thrust section 34 abuts against the outer peripheral surface of the cotter members 24, 25 to push the cotter members 24, 25 to the side of the valve shaft 8. When the cotter members 24, 25 are inwardly pushed, engagement between the lower protrusions 26*b*, 27*b* of the cotter members 24, 25 and the groove 21 located at the upper portion of the valve shaft 8 is maintained.

Thereafter, as shown in FIG. 6-2(D), the spring holder 30 is depressed again. The cotter members 24, 25 are opened by depressing of the spring holder 30.

Then, as shown in FIG. 6-3(E), the drive shaft 11 is lowered to abut the lower end face 11*a* of the drive shaft 11 against the upper end face 8*a* of the valve shaft 8.

After that, as shown in FIG. 6-3(F), the force having pushed down the spring 28 is released. The spring holder 30 is thrust back by the urging force of the spring 28. When the spring holder 30 is thrust back, the cotter thrust section 34 abuts against the outer peripheral surface of the cotter members 24, 25 to push the cotter members 24, 25 radially inwardly, viz., to the side of the valve shaft 8. When the cotter members 24, 25 is inwardly pushed, the upper protrusions 26*a*, 27*a* of the cotter members 24, 25 enter the groove 22 of the drive shaft 11. In other words, as shown in FIG. 3, the protrusions 26*a*, 26*b*, 27*a*, and 27*b* of the cotter members 24, 25 are engaged in the grooves 21, 22, respectively, which leads to a state in which and the valve shaft 8 and the drive shaft 11 are axially integrally fastened to each other. More specifically, the following state is provided: the tapered surfaces 26*e*, 27*e* of the lower protrusions 26*b*, 27*b* of the cotter members 24, 25 abut the tapered surface 21*a* of the groove 21, and the tapered surfaces 26*d*, 27*d* of the upper protrusions 26*a*, 27*a* thereof abut the tapered surface 22*b* of the groove 22.

Figure 7:
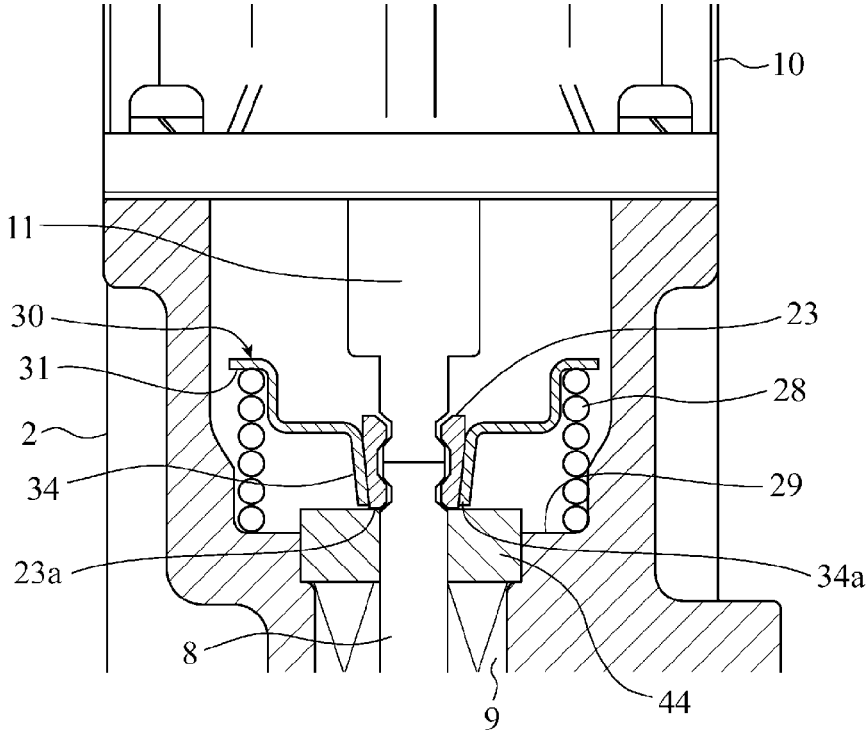
FIG. 7 is a sectional view showing an abutting situation between the cotter and a plug when a valve opening position is determined.

As described above, after the valve shaft 8 and the drive shaft 11 are fastened to each other by the cotter 23, the actuator 10 is, as shown in FIG. 7, driven to extend the drive shaft 11, and thereby abut the lower end face 23*a* of the cotter 23 against the plug 44. With the position as a reference position at which the valve is fully opened, the position is set as the reference position of the valve position reading sensor 12. Soot or the like in the exhaust gas does not easily adhere to the side of the cotter 23 located above the bearing 9, and thus the position is advantageously determined as the reference position.

In the EGR valve 1, since the drive shaft 11 and the valve shaft 8 are axially integrally fastened to each other by the cotter 23, the drive shaft 11 and the valve shaft 8 are translatorily moved to be pushed out by the drive of the actuator 10, and thereby the valve disks 6, 7 are moved from the valve seats 4, 5 to open the passages. During closing of the valve, the valve shaft 8 and the drive shaft 11 are thrust back by the spring 28; however, even if the valve shaft 8 or the other parts enter a sticking state, since the drive shaft 11 and the valve shaft 8 are axially integrally fastened to each other by the cotter 23, the valve shaft 8 is positively returned by the drive force of the actuator 10 to surely close the valve.

According to the EGR valve in accordance with the first embodiment, it is arranged that the valve shaft 8 and the drive shaft 11 is fastened to each other by exerting the urging force of the spring 28 on the cotter 23 that is a fastening member through the spring holder 30, resulting in an extremely simple structure. The cotter 23 that is the fastening member has an outer diameter larger than those of the valve shaft 8 and the drive shaft 11; however, the cotter is set after the valve shaft 8 is passed through the bearing 9, and thus, even if the valve shaft 8 has a member larger than the internal diameter of the bearing 9 on both sides of the valve shaft across the bearing 9, the valve shaft 8 and the drive shaft 11 can be integrally fastened to each other. Further, the cotter 23, the valve shaft 8, and the drive shaft 11 are arranged to abut the protrusions 26*a*, 26*b*, 27*a*, and 27*b* on the side of the cotter 23 against the grooves 21, 22 of the valve shaft 8 and the drive shaft 11 through the tapered surfaces. Thus, backlash can be reduced by a wedge effect, positive positioning can be performed, and rattling or play is not caused. Even if the protrusions 26*a*, 26*b*, 27*a*, and 27*b* of the cotter 23, the grooves 21, 22 of the valve shaft 8 and the drive shaft 11, and the abutment surfaces 8*a*, 11*a* of the valve shaft 8 and the drive shaft 11 are somewhat worn, the fastening state is not changed, and high durability can be maintained.

Furthermore, according to the EGR valve, the valve shaft 8 and the drive shaft 11 are axially unitized, and thus, even if the valve disks 6, 7, and the valve shaft 8 go to a sticking state, the valve shaft 8 can be lifted by the driving force of the actuator 10 that is the drive unit. The cotter 23 that is a fastening member is formed without using press fitting or welding. Thus, the ability of the exhaust gas recirculation valve to be assembled and produced in quantity is high, and the valve can be easily disassembled and reassembled.

Moreover, in accordance with the first embodiment, the position at which the lower end face 23*a* of the cotter 23 abuts against the plug 44 on the side of the valve housing 2, and which exists in the area to which soot or the like in an exhaust gas does not easily adhere, is determined as a reference position for a valve opening position, and thus it becomes easy to accurately find the reference position. Further, the mating faces of the two cotter members 24, 25 constituting the cotter 23 are arranged to have a labyrinth structure 45, and thus it is possible to prevent soot or the like contained in an exhaust gas from entering the cotter.

In the first embodiment, since the cotter 23 is produced by a sinter-forming process, the outer peripheral surfaces and the tapered surfaces of the protrusions 26*a*, 26*b*, 27*a*, and 27*b* of the cotter can be precisely formed at a desired angle, and therefore chattering, backlash and the like are not caused when fastening with the cotter 23 is performed.

Besides, according to the method of fastening the valve shaft 8 and the drive shaft 11 with the cotter 23, shown in FIG. 6, the above-discussed EGR valve having a novel structure can be produced in extremely easy processes.

Second Embodiment

Figure 8:
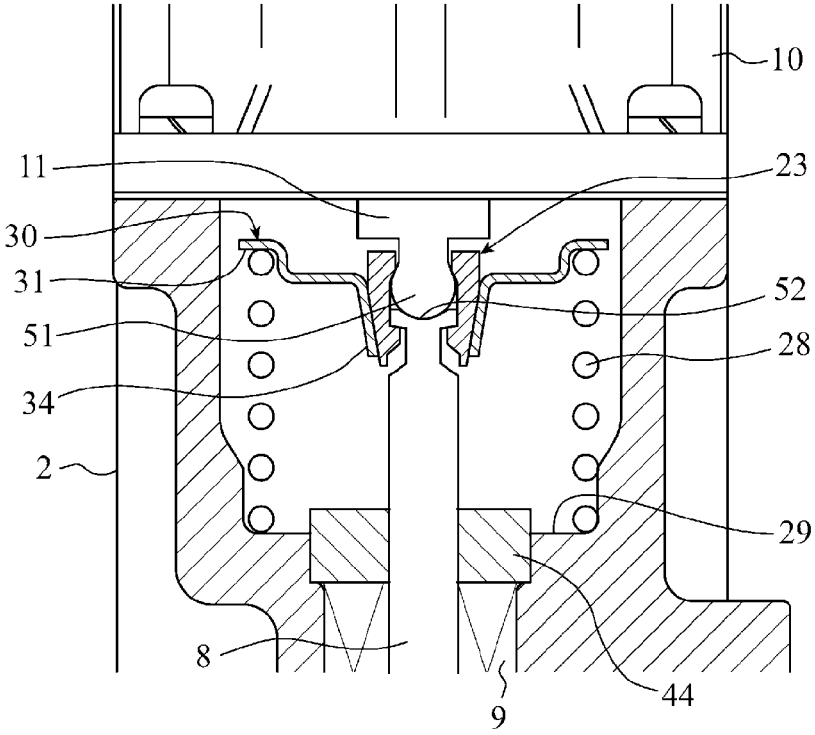
FIG. 8 is a partial sectional view of a second embodiment of an EGR valve according to the present invention.

FIG. 8 illustrates a fastening portion between the valve shaft and the drive shaft of an EGR valve in accordance with the second embodiment. In accordance with the embodiment, it is arranged that a drive shaft 11 have a spherical portion 51 at the lower end thereof, and that the upper end of a valve shaft 8 for abutting against the portion is provided with a concavely curved surface 52. The other structure thereof is the same as that of the first embodiment.

In such a way, when the abutting surfaces between the valve shaft 8 and the drive shaft 11 are thus curved, a dislocation between the valve shaft 8 and the drive shaft 11 can be absorbed. Therefore, an assembly error occurring between the valve shaft 8 and the drive shaft 11 can be absorbed. Alternatively, it may be arranged that the valve shaft 8 have a spherical portion at the upper end thereof and that the drive shaft 11 have a curved surface at the lower end thereof, resulting in the same operation/effect.

INDUSTRIAL APPLICABILITY

As discussed above, the exhaust gas recirculation valve according to the present invention is arranged such that the fastening member for fastening the end of the drive shaft and that of the valve shaft to each other is provided when it is radially urged by the spring through the spring holder. Thus, the structure of the valve can be simplified, and further, even if there is a portion of which the outer diameter is larger than the inner diameter of the bearing for supporting the valve shaft on both sides with the bearing as a boundary, the valve shaft and the drive shaft can be integrally fastened to each other. Therefore, the exhaust gas recirculation valve is suitable for use in an exhaust gas recirculation valve provided in a recirculation passage of an exhaust gas of an engine.

The invention claimed is:

1. An exhaust gas recirculation valve comprising:

a drive unit;

a drive shaft that is translated by the drive unit;

a valve shaft which has a valve disk that is closed and opened to and from a valve seat provided in a valve housing and which is axially translated by the translatory force of the drive shaft;

a spring for urging the valve shaft and the drive shaft in a valve closing direction through a spring holder; and a bearing for journaling the valve shaft, wherein a fastening member for fastening the end of the drive shaft and the end of the valve shaft to each other is provided by the fastening member being radially urged by the spring through the spring holder.

2. The exhaust gas recirculation valve according to claim 1, wherein the spring holder has a taper;

wherein the taper is abutted against the fastening member by the urging force of the spring, and the fastening member is composed of a plurality of members that are axially divided, and also radially inwardly has protrusions; and wherein the protrusions abut against a groove provided in the drive shaft and a groove provided in the valve shaft to fasten the drive shaft and the valve shaft to each other by the urging force of the spring.

3. The exhaust gas recirculation valve according to claim 2, wherein the protrusion of the fastening member has tapers, and the taper abuts against a taper provided in the groove of the drive shaft and also a taper provided in the groove of the valve shaft.

4. The exhaust gas recirculation valve according to claim 2, wherein the opposing section of the plurality of members of the fastening member has a labyrinth shape.

5. The exhaust gas recirculation valve according to claim 2, wherein the end on the valve disk side of the fastening member projects to the valve disk side further than that on the valve disk side of the spring holder.

6. The exhaust gas recirculation valve according to claim 2, wherein the fastening member is formed by sintering.

7. The exhaust gas recirculation valve according to claim 1, wherein the abutting section of at least one of the drive shaft and the valve shaft has a curved shape.

8. A manufacturing method of an exhaust gas recirculation valve including:

a drive unit;

a drive shaft that is translated by the drive unit;

a valve shaft which has a valve disk that is closed and opened to and from a valve seat provided in a valve housing and which is axially translated by the translatory force of the drive shaft;

a spring for urging the valve shaft and the drive shaft in a valve closing direction through a spring holder;

a bearing for journaling the valve shaft; and a fastening member for fastening the end of the drive shaft and the end of the valve shaft to each other by the fastening member being radially urged by the spring through the spring holder, said method comprising the steps of:

fastening the valve shaft and the fastening member to each other such that a protrusion of the fastening member is abutted against a groove of the valve shaft under a condition where the spring holder is thrust in a direction opposite to an urging force of the spring; and fastening the valve shaft and the fastening member to each other such that the protrusion of the fastening member is abutted against a groove of the drive shaft under a condition where the spring holder is thrust against an urging force of the fastening member, to thus release the thrust of the spring holder.

* * * * *